United States Patent [19]

Meshberg

[11] 4,456,153

[45] Jun. 26, 1984

[54] TRIGGER ATTACHMENT FOR PUMPS

[76] Inventor: Philip Meshberg, 2500 S. Ocean Blvd., Palm Beach, Fla. 33480

[21] Appl. No.: 312,260

[22] Filed: Oct. 13, 1981

[51] Int. Cl.[3] ..... B65D 83/14; B67D 5/42

[52] U.S. Cl. ..... 222/321; 222/324; 222/383; 222/402.13; 222/473; 222/509

[58] Field of Search ..... 222/321, 383, 385, 402.14, 222/402.13, 402.15, 509, 470, 472–474, 323, 324, 402.1, 372, 380, 192

[56] References Cited

U.S. PATENT DOCUMENTS

| | | | |
|---|---|---|---|
| 1,900,668 | 3/1933 | Roselund | 222/324 |
| 2,626,185 | 1/1953 | Roselund | 222/324 X |
| 3,189,232 | 6/1965 | Joffe | 222/509 X |
| 3,478,935 | 11/1969 | Brooks | 222/321 |
| 4,077,549 | 3/1978 | Beard | 222/321 |
| 4,157,774 | 6/1979 | Micallef | 222/321 |

*Primary Examiner*—Joseph J. Rolla
*Assistant Examiner*—Kevin P. Shaver
*Attorney, Agent, or Firm*—Kenyon & Kenyon

[57] ABSTRACT

A trigger attachment, for a finger operated pump having an axially outwardly projecting actuating and dispensing stem having therein an axial bore through which material is dispensed upon axial inward movement of the stem, has a body attached to the pump body and a generally vertically extending portion which can be griped by the hand, a trigger mechanism hinged to the body and adapted to be coupled to said actuating stem, the trigger mechanism converting a radial motion of the trigger with respect to the body into axial inward motion at the actuating stem, and a nozzle coupled to the outlet bore in said actuating stem.

5 Claims, 2 Drawing Figures

TRIGGER ATTACHMENT FOR PUMPS

BACKGROUND OF THE INVENTION

This invention relates to hand operated pumps in general and more particularly to trigger attachments for converting a finger actuated spray pump dispenser to a trigger pump.

Particularly, in view of concern over fluorocarbons in the atmosphere, there have been developed a number of finger actuated pumps which permit dispensing of various liquid and viscous materials either in a spray or stream. Typical of such pumps are the pumps disclosed in my U.S. Pat. No. 4,113,145 and in U.S. Pat. No. 4,274,560. The types of pumps disclosed in these two patents are generally to be operated by pushing down on an actuator, having a spray tip and mounted on an axially outwardly projecting stem, with the finger, i.e., they are operated by an axial inward finger motion. In U.S. Pat. No. 4,274,560, a trigger pump is shown. However, it is designed from the start as a trigger pump. Many other types of trigger pumps have also been designed and are of varying degrees of complexity.

The axial finger operated pump has been developed and refined and is a very workable device. However, in cases where repeated sprayings are required, or in cases where a viscous material is to be dispensed, operating it can become tiresome. For this purpose a trigger pump is desirable.

Since, the axially actuated finger pump has proven itself, the desirability to convert it for trigger operation is clear. Such has been previously attempted. One example is the device disclosed in U.S. Pat. No. 4,186,855. Here, a lever is pivoted and has a portion which contacts the top of the actuator normally pressed by the finger. This is not truly what one would call a trigger pump, however, since one pushes on the lever rather than pulls as one does with a trigger. Furthermore, it suffers from the disadvantage that the actuator moves axially during dispensing, making aiming more difficult.

It is, thus, an object of the present invention to provide an improved mechanism for converting a pump normally operated by axial finger motion into a trigger pump.

SUMMARY OF THE INVENTION

In accordance with the present invention to accomplish this, a body portion of a trigger attachment is secured to the cap or mounting cup on a container having a finger-operated pump installed, thus, rigidly attaching the body to the container and through it to the pump body. A trigger mechanism is pivoted to the body and is mechanically coupled to the actuating stem in such a manner as to convert a radial trigger motion into an axial motion at the stem. Coupled to the stem is a nozzle which permits directing a stream or spray of the material to be dispensed.

Preferably, the spray tip or nozzle is mounted to the body which is secured to the cap or mounting cup. One advantage of this construction is that, during dispensing, the nozzle never moves. In order to permit the nozzle to remain fixed while the stem moves, there is a tube in communication with the nozzle which cooperates with the stem projecting from the pump with a sliding fit. The trigger is adapted to engage the stem and move the stem up and down. The stem then slides with respect to the stationary tube. For example, in one embodiment the tube may slide inside an enlarged actuating stem portion. This permits the trigger to have a yoke which fits around the stationary tube to engage the top of the actuating stem. In another embodiment, the stationary tube is of a larger diameter and the stem slides within it. In this case, the stem is formed with radially extending projections by means of which the trigger lever can engage and operate the stem.

Embodiments which include a rear trigger and a front trigger are disclosed.

DETAILED DESCRIPTION

One pump that can be used with the trigger attachments of the present invention is that disclosed in my U.S. Pat. No. 3,211,346. Furthermore, the pump described in U.S. Pat. No. 4,274,560, which is a prepressurized pump may also be used. The key characteristic of both these pumps is that they have a dispensing stem which, when depressed operates a piston to force material out of an axial bore in the dispensing stem.

Figure 1:
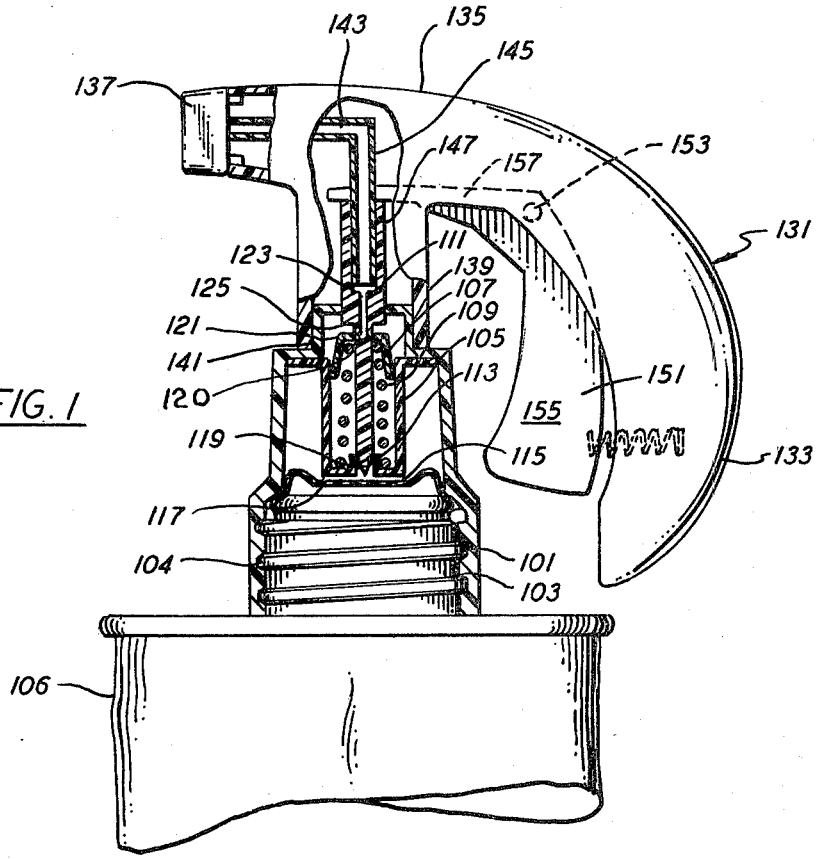
FIG. 1 is a cross-sectional view of a first embodiment of the present invention.

In the embodiment of FIG. 1, the pump is contained within a casing 101 having a lower inner portion 103 which is threaded to screw onto matching threads on the neck of a container. The container can be, for example, a container with a flexible lower portion and an upper rigid portion of the type disclosed in my copending application Ser. No. 310,987, filed on even date herewith.

The pump includes a tank or body portion 105 defining a cylinder in which a piston 107 is adapted to slide. Piston 107 is biased outwardly by a spring 109. A pump stem 111 extends through the piston and is guided at the lower end of the tank 105 by a cylindrical member 113 surrounding an opening 115 at the bottom of the tank. In the illustrated embodiment, the container 106 has, at the end of its neck 104, a seal 117 of plastic, aluminum foil or the like. The end of the stem 111 has a point 119. Movement of the stem inwardly during the first actuation will thus cause the point 119 to pierce the seal 117.

The biasing spring 109 acts against a flange 121 on the stem 111. In the position shown, flange 121 is abutting against piston 107. In this position, an inlet port 120 to the axial outlet passage of the stem 111 is closed or blocked by the piston. There is, however, a path for fluid to enter the pump chamber 105 from the container there being a gap between the pointed end 119 and the cylindrical member 113. When the stem 111 is moved inwardly, an enlarged portion 125 of the stem 111 comes to abut against the piston 107. In other words, the stem 111 slides within the piston 107, uncovering the radial inlet port 120 so that, as the piston 107 is then moved inwardly, fluid within the pump chamber 105 will be forced through the outlet passage 123.

By placing an actuator on the end of a stem 111, a normal finger operated dispensing pump would result. However, in the illustrated embodiment, a trigger spray attachment is provided. The trigger spray attachment includes a body 131 which has a pistol grip handle 133, a horizontal portion 135 extending therefrom, at the end of which is a nozzle or spray tip 137, and, extending downwardly from the horizontal portion, a hollow cylindrical portion 139 which is press fitted over a top cylindrical portion 141 on the cap 101 supporting the pump. The portion 135, near the end where the nozzle 137 is attached, is also of hollow cylindrical shape. Extending from the nozzle 135 is an L-shaped stationary, rigid tube 143. Tube 143 has its axially extending leg 145 inserted into the outer end 147 of the actuating stem 111 and slidably fits therein. The remainder of the body 133, particularly in the handle area and in the area directly above the stem 111 is of U-shaped cross section. A trigger 151 is hinged to the body 133 at a pivot pin 153. The trigger 151 has a portion 155 which is grasped by the finger and extends inwardly and a horizontally extending portion 157 which terminates in a yoke which slips around the stationary tube 143 and bears upon the stem 111. A user grasping the handle portion 133 and pulling on the trigger 135 will thus cause the stem 111 to be pushed axially inwardly to dispense material through the stationary tube and out the nozzle 137. An additional spring 158 aids spring 109 in returning the stem and trigger to the non-dispensing position.

Figure 2:
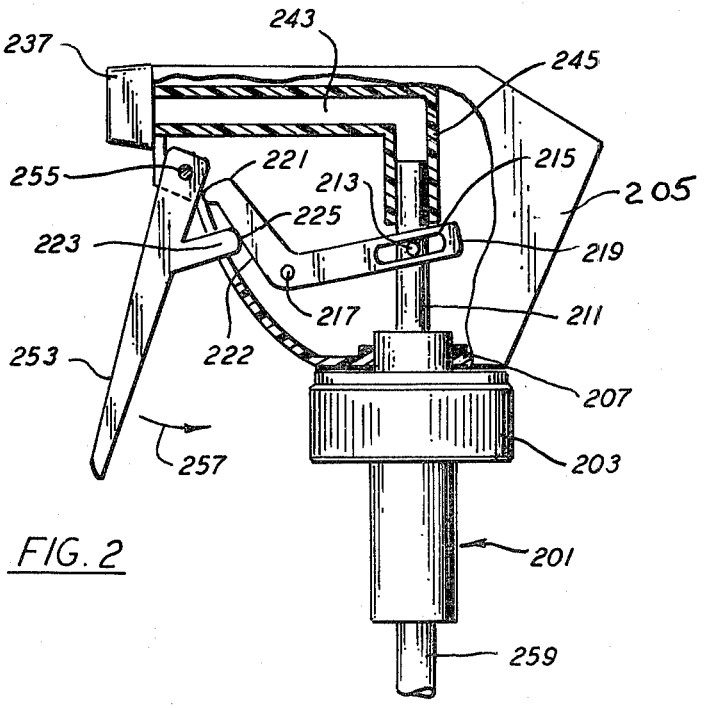
FIG. 2 is a side view partially in phantom, of a second embodiment of the trigger spray attachment of the present invention.

Alternatively, the stationary tube 143 and stem 111 may have relative dimensions such that the stem 111 slides within the stationary tube 143. An embodiment of this nature but with a somewhat different actuating mechanism is shown in FIG. 2. In FIG. 2, a pump body 201 is shown mounted in a cap 203. Preferably, this is a pre-pressure pump of the type described in U.S. Pat. No. 4,274,560. The pump can deliver a large dose of, for example, 1 cc. Once again, there is a rigid body or housing portion 205 which mounts onto a suitable cylindrical portion 207 of the cap 203. Extending from the cap 203 as part of the pump 201 is a stem 211. Stem 211 contains on its outside radially extending pins or extensions 213. The stem 211 is surrounded by a yoke having slots 215 on opposite side thereof within which the pins 213 may slide. Once again, a spray tip or nozzle 237 is provided with a rigid, L-shaped tube 243 extending therefrom. In this case, the axially extending portion 245 of the rigid tube fits over the stem 211.

Slots 215 are formed in a lever arm 219 having a yoked end. The other arm 221 of the lever has an outer surface 222 against which an angularly projecting arm 223 with a rounded end 225 acts to rotate the lever, the lever being hinged about a pin 217. Projecting arm 223 projects from an actuating lever 253 which itself is hinged about a pin 255. Moving the lever 253 radially inwardly results in a radial inward motion of the lever arm 221 which is converted to an axial inward motion at the stem 211.

The levers of FIG. 2 give a larger throw than the single lever of FIG. 1. The FIG. 1 lever may be limited to moving the actuating stem about ¼", where that of FIG. 2 is capable of about twice that movement. Other arrangements of lever may be used as required to get the desired degree of "throw".

It will be recognized that the method of yoke attachment of FIG. 1 can be used in FIG. 2 and visa versa. Furthermore, the pins 213 and slots 215 can be reversed, i.e., slots may be formed in stem 211 and pins on art 219.

It should also be noted that in the embodiment of FIG. 2, a pump of conventional design which is vented and which includes a dip tube 259 is shown. The present invention is also useful with non-vented pumps as disclosed in my copending application Ser. No. 310,987. Furthermore, the present invention not limited to the specific types of pumps disclosed in the aforementioned applications. Basically, the trigger attachments of the present invention can be used with any pump designed to be operated by depressing or inwardly moving a projecting actuating stem.

In addition, a further aspect of the present invention is considered to be in the design of a pump such that it can be used either for axial finger operation or with a trigger spray attachment according to the present invention. An examination of FIGS. 1 and 2, will show that such can be accomplished by adapting the end of the stem 211 in either case such that it can make a sliding mating fit with a stationary tube in a trigger attachment and by providing means on the stem for engaging an actuating lever. In the case of FIG. 2, the means are the projecting pins 213. In the case of the embodiment of FIG. 1, these means are the enlarged outer end of the actuating stem 111 which is adapted to have the stationary tube slide inside it. In addition, as noted above, partial bores can be made in the outside of the stem and pins on the yoke engage in these bores to operate the actuating stem. Other coupling possibilities will suggest themselves to those skilled in the art.

The arrangement of the present invention is particularly beneficial for operating large dosage pumps, e.g., 1 cc. pumps. In combination with a pre-pressure pump of large dosage as described in connection with FIG. 2, the trigger attachment will insure an even spray from beginning to end, without dribble, something which is difficult to attain in most conventional trigger pumps.

What is claimed is:

1. A trigger attachment for a finger operated pump having a pump body and an axially outwardly projecting actuating and dispensing stem having therein an axial outlet bore through which material is dispensed upon axial inward movement of said stem, said pump body adapted to be mounted to a container, comprising:

a. a trigger body including:
   i. a partially vertically extending pistol grip;
   ii. a horizontal portion extending from said pistol grip terminating in a hollow cylindrical portion;
   iii. a hollow cylindrical vertical portion extending downwardly from said horizontal portion and rigidly coupling said trigger body to said pump body;

b. a trigger mechanism comprising an essentially right angular member having first and second arms, said first arm terminating in means engaging said stem and the second arm spaced from said vertically extending pistol grip, hinged to said trigger body, said trigger mechanism adapted to convert a radial motion of said trigger mechanism with respect to said trigger body into axial inward motion at said actuating stem;

c. a nozzle mounted to said hollow cylindrical horizontal portion of said trigger body such as to remain in a fixed position with respect to both said pump body and said trigger body; and d. a rigid stationary tube adapted to slidingly mate with actuating stem coupling said nozzle to the outlet bore in said stem.

2. A trigger spray attachment according to claim 1, wherein said tube is received in a bore in said stem.

3. A trigger spray attachment according to claim 1, in combination with a pre-pressurized pump.

4. A trigger attachment for a finger operated pump having a pump body and an axially outwardly projecting actuating and dispensing stem having therein an axial outlet bore through which material is dispensed upon axial inward movement of said stem, said pump body adapted to be mounted to a container, comprising:

a. a trigger body including:

i. a vertically extending portion of essentially hollow construction rigidly coupling said trigger body to said pump body;

ii. a rigid stationary tube adapted to slidingly mate with said actuating stem;

iii. a spray tip nozzle in said trigger body coupled to said stationary tube; and b. a trigger mechanism hinged to said trigger body comprising:

i. a lever having two arms enclosing an angle, on arm slidably engaging said stem, said lever pivoted within said vertically extending hollow portion; and ii. a finger grip pivoted and extending out from said trigger body and having a projection engaging the other of said two arms, movement of said finger grip toward said body rotating said lever to actuate said pump.

5. A trigger spray attachment according to claim 4, wherein said tube surrounds said stem.

* * * * *